US012742390B2

(12) United States Patent
Kopache et al.

(10) Patent No.: US 12,742,390 B2
(45) Date of Patent: Sep. 22, 2026

(54) TWO-STROKE ROTARY ENGINE WITH IMPROVED INLET AND OUTLET PORTS

(71) Applicant: LiquidPiston, Inc., Bloomfield, CT (US)

(72) Inventors: Alexander Kopache, Simsbury, CT (US); Rodrigo Eguiluz Carretero, Manchester, CT (US); Tiago Costa, Vila Nova de Famalicao (PT); Mark Nickerson, Falmouth, ME (US); Saad Ahmed, West Hartford, CT (US); Bryant Rosato, Valencia, CA (US); Adam Spitulnik, Hartford, CT (US); Alexander Shkolnik, Wilmington, MA (US); Nikolay Shkolnik, West Hartford, CT (US)

(73) Assignee: LiquidPiston, Inc., Bloomfield, CT (US)

( * ) Notice: Subject to any disclaimer, the term of this patent is extended or adjusted under 35 U.S.C. 154(b) by 0 days.

(21) Appl. No.: 19/108,561

(22) PCT Filed: Sep. 6, 2023

(86) PCT No.: PCT/US2023/073526
§ 371 (c)(1),
(2) Date: Mar. 4, 2025

(87) PCT Pub. No.: WO2024/054830
PCT Pub. Date: Mar. 14, 2024

(65) Prior Publication Data

US 2026/0078674 A1 Mar. 19, 2026

Related U.S. Application Data

(60) Provisional application No. 63/404,031, filed on Sep. 6, 2022.

(51) Int. Cl.
*F01C 21/18* (2006.01)

(52) U.S. Cl.
CPC ..... *F01C 21/18* (2013.01)

(58) Field of Classification Search
CPC ..... F01C 1/10; F01C 21/18
See application file for complete search history.

(56) References Cited

U.S. PATENT DOCUMENTS 3,224,421 A * 12/1965 Peras ..... F01C 21/18 418/61.3
3,410,254 A 11/1968 Huf
(Continued)

FOREIGN PATENT DOCUMENTS

DE 1776240 B1 8/1965

OTHER PUBLICATIONS

International Searching Authority—International Search Report, pertaining to International Application No. PCT/US23/73526 dated Jan. 10, 2024, together with the Written Opinion of the International Searching Authority, 14 pages.

*Primary Examiner* — Ngoc T Nguyen
(74) *Attorney, Agent, or Firm* — Merchant & Gould P.C.

(57) ABSTRACT

Rotary engine including a cycloidal rotor having N identical lobes, each lobe having a contour defined by a silhouette of the lobe, and a housing having a corresponding set of N+1 lobe-receiving regions, wherein N>2, the housing having a pair of side plates axially disposed on first and second sides of the rotor, at least one working chamber being formed in a space between the rotor and the housing and having an exhaust port and an intake port each having a top edge, the intake and exhaust ports being configured so that: (a) a leading portion of the top edge of the exhaust port has a contour that matches a first corresponding portion of the contour of the given lobe when the rotor is in an angular orientation just before any opening by the given lobe of the
(Continued)

exhaust port, and (b) a trailing portion of the top edge of the exhaust port has a contour that matches a second corresponding portion of the contour of the given lobe when the rotor is in an angular orientation when the exhaust port is first fully closed.

18 Claims, 9 Drawing Sheets

(56) References Cited

U.S. PATENT DOCUMENTS

| | | | | |
|---|---|---|---|---|
| 3,872,838 | A * | 3/1975 | Vogelsang | F01C 19/04 418/187 |
| 3,967,594 | A | 7/1976 | Campbell | |
| 9,810,068 | B2 | 11/2017 | Shkolnik et al. | |

* cited by examiner

1 - Side Plate
2 - Housing
3 - Rotor
4 - Intake Port
5 - Exhaust Port
6 - Working chamber boundary
12 - Working chamber 7 - Leading portion of the top edge of the exhaust port
8 - Trailing portion of the top edge of the exhaust port
9 - Leading portion of the top edge of the intake port
10 - Trailing portion of the top edge of the intake port
11 - Separator wall (Exhaust port and intake port partially open)

(Intake port fully open, exhaust port partially open)

(Exhaust port fully closed)

(Exhaust port and intake port fully closed)

TWO-STROKE ROTARY ENGINE WITH IMPROVED INLET AND OUTLET PORTS

CROSS-REFERENCE TO RELATED APPLICATIONS

This application is a national stage entry of International Application No. PCT/US23/73526, filed Sep. 6, 2023, which claims the benefit of U.S. Provisional Application No. 63/404,031 filed Sep. 6, 2022, the disclosure of each of which is incorporated by reference herein in its entirety.

TECHNICAL FIELD

The present invention relates to intake and exhaust port design for two-stroke rotary engines.

SUMMARY OF THE EMBODIMENTS

In accordance with one embodiment of the invention, an improved engine of the type including a cycloidal rotor having N identical lobes, each lobe having a contour, the contour being defined by a silhouette of the lobe, and a housing having a corresponding set of N+1 lobe-receiving regions, wherein N≥2, for successively receiving the lobes as the rotor rotates about an axis relative to the housing, the housing having (i) a pair of side plates axially disposed on first and second sides of the rotor, each of the side plates defining an interior plane with which the rotor is in contact, and (ii) a peak disposed between each pair of adjacent lobe-receiving regions, at least one working chamber being formed in a space between the rotor and the housing, the at least one working chamber having an exhaust port and an intake port, each port communicating with the at least one working chamber through one of the side plates, such ports being closed successively by the lobes during rotation of the rotor and opened to the at least one working chamber as a given lobe is rotated, the intake port having a top edge and the exhaust port having a top edge, wherein the improvement comprises configuring the intake port and the exhaust port so that (a) a leading portion of the top edge of the exhaust port has a contour that matches a first corresponding portion of the contour of the given lobe when the rotor is in an angular orientation just before any opening by the given lobe of the exhaust port, and (b) a trailing portion of the top edge of the exhaust port has a contour that matches a second corresponding portion of the contour of the given lobe when the rotor is in an angular orientation when the exhaust port is first fully closed.

In accordance with another embodiment of the invention, an improved engine of the type including a cycloidal rotor having N identical lobes, each lobe having a contour, the contour being defined by a silhouette of the lobe, and a housing having a corresponding set of N+1 lobe-receiving regions, wherein N≥2, for successively receiving the lobes as the rotor rotates about an axis relative to the housing, the housing having (i) a pair of side plates axially disposed on first and second sides of the rotor, each of the side plates defining an interior plane with which the rotor is in contact, and (ii) a peak disposed between each pair of adjacent lobe-receiving regions, at least one working chamber being formed in a space between the rotor and the housing, the at least one working chamber having an exhaust port and an intake port, each port communicating with the at least one working chamber through one of the side plates, such ports being closed successively by the lobes during rotation of the rotor and opened to the at least one working chamber as a given lobe is rotated, the intake port having a top edge and the exhaust port having a top edge, wherein the improvement comprises configuring the intake port and the exhaust port so that (a) a leading portion of the top edge of the intake port has a contour that matches a third corresponding portion of the contour of the given lobe when the rotor is in an angular orientation just before any opening by the given lobe of the intake port, and (b) a trailing portion of the top edge of the intake port has a contour that matches a fourth corresponding portion of the contour of the given lobe when the rotor is in an angular orientation when the intake port is first fully closed.

In accordance with an embodiment of the invention, an improved engine of the type including a cycloidal rotor having N identical lobes, each lobe having a contour, the contour being defined by a silhouette of the lobe, and a housing having a corresponding set of N+1 lobe-receiving regions, wherein N≥2, for successively receiving the lobes as the rotor rotates about an axis relative to the housing, the housing having (i) a pair of side plates axially disposed on first and second sides of the rotor, each of the side plates defining an interior plane with which the rotor is in contact, and (ii) a peak disposed between each pair of adjacent lobe-receiving regions, at least one working chamber being formed in a space between the rotor and the housing, the at least one working chamber having an exhaust port and an intake port, each port communicating with the at least one working chamber through one of the side plates, such ports being closed successively by the lobes during rotation of the rotor and opened to the at least one working chamber as a given lobe is rotated, the intake port having a top edge and the exhaust port having a top edge, wherein the improvement comprises configuring the intake port and the exhaust port so that (a) a leading portion of the top edge of the exhaust port has a contour that matches a first corresponding portion of the contour of the given lobe when the rotor is in an angular orientation just before any opening by the given lobe of the exhaust port, (b) a trailing portion of the top edge of the exhaust port has a contour that matches a second corresponding portion of the contour of the given lobe when the rotor is in an angular orientation when the exhaust port is first fully closed, (c) a leading portion of the top edge of the intake port has a contour that matches a third corresponding portion of the contour of the given lobe when the rotor is in an angular orientation just before any opening by the given lobe of the intake port, and (d) a trailing portion of the top edge of the intake port has a contour that matches a fourth corresponding portion of the contour of the given lobe when the rotor is in an angular orientation when the intake port is first fully closed.

In some embodiments, the exhaust port has an exhaust port area, at its corresponding interior plane, that is greater than an intake port area of the intake port at its corresponding interior plane. In other embodiments, the intake port has an intake port area, at its corresponding interior plane, that is greater than an exhaust port area of the exhaust port at its corresponding interior plane. In some embodiments, the exhaust port has an exhaust port area, at its corresponding interior plane, that is equal to an intake port area at its corresponding interior plane.

The exhaust port area may be at least 50% greater than the intake port area. The exhaust port area may be at least three times greater than the intake port area. The intake port area may be at least three times greater than the exhaust port area. The intake port area may be at least 50% greater than the exhaust port area. The exhaust port area may be at least two times greater than the intake port area. The intake port area may be at least two times greater than the exhaust port area.

In some embodiments, a separator wall separates the exhaust port from the intake port. In some embodiments, the exhaust port comprises at least one bridge. In some embodiments, the intake port comprises at least one bridge.

The engine may further include a fuel injector configured to inject fuel into the at least one working chamber.

In some embodiments, the exhaust port and the intake port are configured in the side plate in a manner so that when the rotor is in a position causing the exhaust and intake ports to be fully closed, further rotation of the rotor in its normal direction of rotation will cause the exhaust port to open before the intake port.

In some embodiments, the exhaust port and the intake port are configured in the side plate in a manner so that when the rotor is in a position causing the exhaust and intake ports to be open, further rotation of the rotor in its normal direction of rotation will cause the exhaust port to be fully closed before the intake port is fully closed.

BRIEF DESCRIPTION OF THE DRAWINGS

The foregoing features of embodiments will be more readily understood by reference to the following detailed description, taken with reference to the accompanying drawings, in which.

DETAILED DESCRIPTION OF SPECIFIC EMBODIMENTS

Figure 5A:
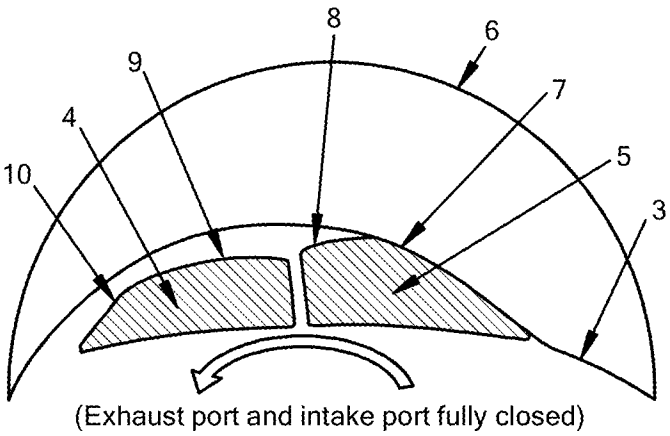
FIG. 5*a* is a working chamber in which the exhaust port and the intake port are each fully closed to the working chamber by a rotor as the rotor rotates counter-clockwise within a two-stroke rotary engine, and wherein the rotor is in a position just before any opening the exhaust port, in accordance with an embodiment of the present invention.
Figure 5B:
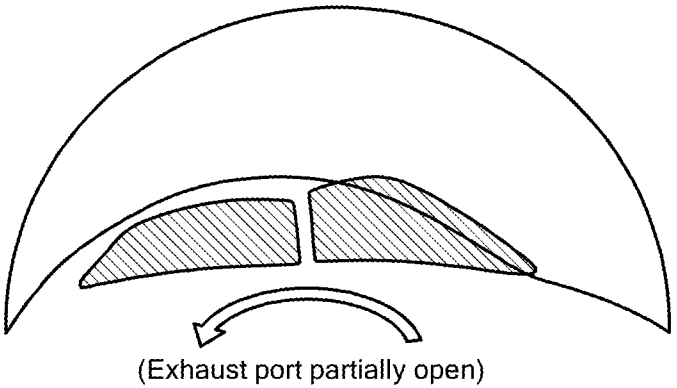
FIG. 5*b* is a working chamber in which the exhaust port is partially open and the intake port is fully closed to the working chamber by the rotor as the rotor rotates counter-clockwise within the two-stroke rotary engine, in accordance with an embodiment of the present invention.
Figure 5C:
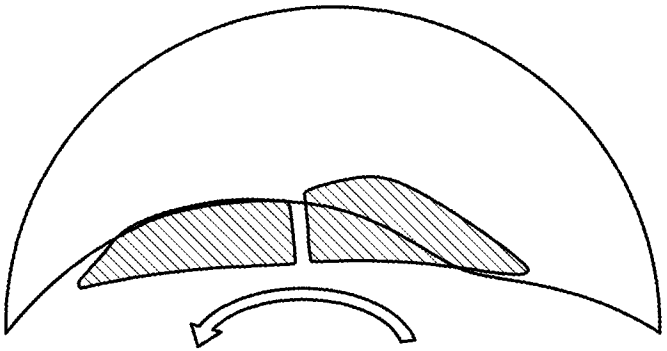
FIG. 5*c* is a working chamber in which the exhaust port is partially open and the intake port is fully closed to the working chamber, and wherein the rotor is in a position just before any opening the intake port by the rotor as the rotor rotates counter-clockwise within the two-stroke rotary engine, in accordance with an embodiment of the present invention.
Figure 5D:
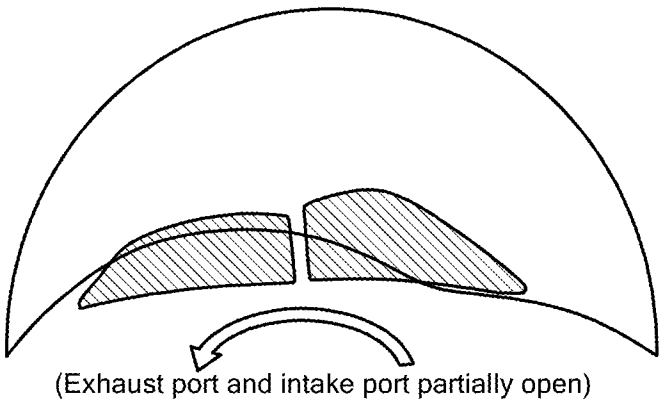
FIG. 5*d* is a working chamber in which the exhaust port is partially open and the intake port is partially open to the working chamber as the rotor rotates counter-clockwise within the two-stroke rotary engine, in accordance with an embodiment of the present invention.
Figure 5E:
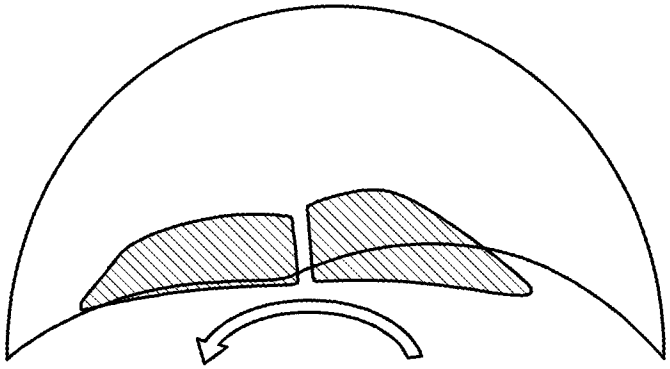
FIG. 5*e* is a working chamber in which the exhaust port is partially open and the intake port is partially open to the working chamber as the rotor rotates counter-clockwise within the two-stroke rotary engine, in accordance with an embodiment of the present invention.
Figure 5F:
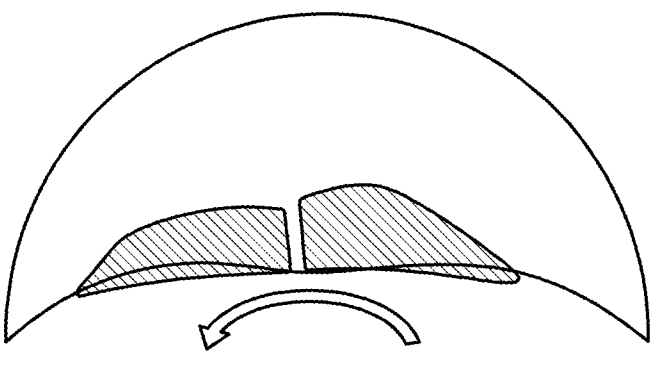
FIG. 5*f* is a working chamber in which the exhaust port is partially open and the intake port is fully open to the working chamber as the rotor rotates counter-clockwise within the two-stroke rotary engine, in accordance with an embodiment of the present invention.

As used herein, the contour of a given leading edge of a given port "matches" the contour of a corresponding portion of a given rotor if, upon an infinitesimal angular displacement, of the rotor, by which the rotor first exposes the given port to a given working chamber, an exposed area of the given port is substantially the same as (i.e., at least 90% of) a maximum possible area available to be exposed by the given rotor by the infinitesimal angular displacement. For example, FIG. 5*b* can be understood as showing an exaggerated version of the infinitesimal angular displacement hypothesized by this definition. In FIG. 5*b*, it can be seen that the area exposed by this hypothesized angular displacement approaches a maximum, because the relevant contour of the corresponding portion of the rotor matches the relevant contour of the given leading edge.

Figure 5G:
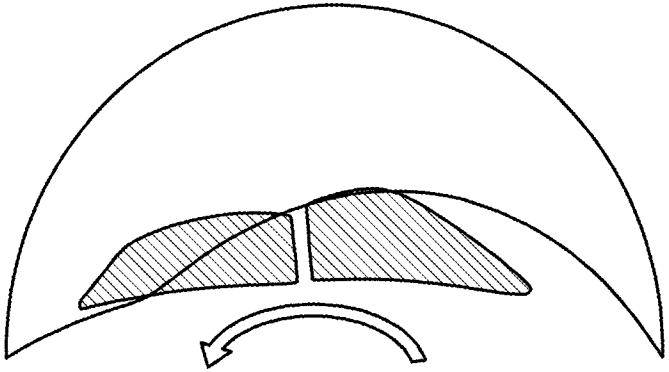
FIG. 5*g* is a working chamber in which the exhaust port is fully closed and the intake port is partially open to the working chamber as the rotor rotates counter-clockwise within the two-stroke rotary engine, and wherein the rotor is in a position just as the exhaust port becomes fully closed to the working chamber, in accordance with an embodiment of the present invention.
Figure 5H:
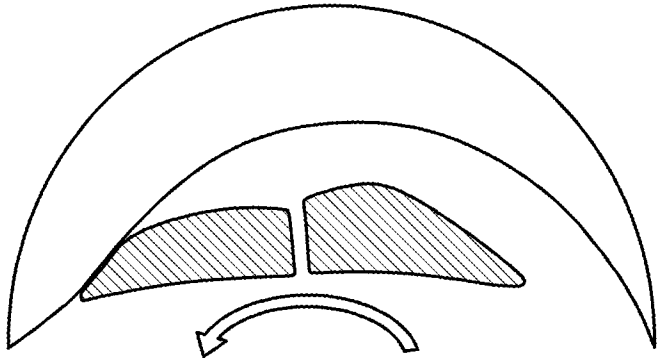
FIG. 5*h* is a working chamber in which the exhaust port and the intake port are each fully closed to the working chamber by a rotor as the rotor rotates counter-clockwise within the two-stroke rotary engine, and wherein the rotor is in a position just as the intake port becomes fully closed to the working chamber, in accordance with an embodiment of the present invention.

Similarly, as used herein, the contour of a given trailing edge of a given port "matches" the contour of a corresponding portion of a given rotor if, just before an infinitesimal angular displacement, of the rotor, has first fully closed the given port to the given working chamber, an area of the given port remaining exposed to the given working chamber is substantially the same as (i.e., at least 90% of) a maximum possible area of the given port remaining exposed. In this context, FIG. 5*g* illustrates a point in rotation of the rotor wherein the rotor has first fully closed the exhaust port, and the infinitesimal angular displacement just before this event can be imagined as occurring an instant before the rotor reaches the position illustrated in FIG. 5*g*.

Figure 1:
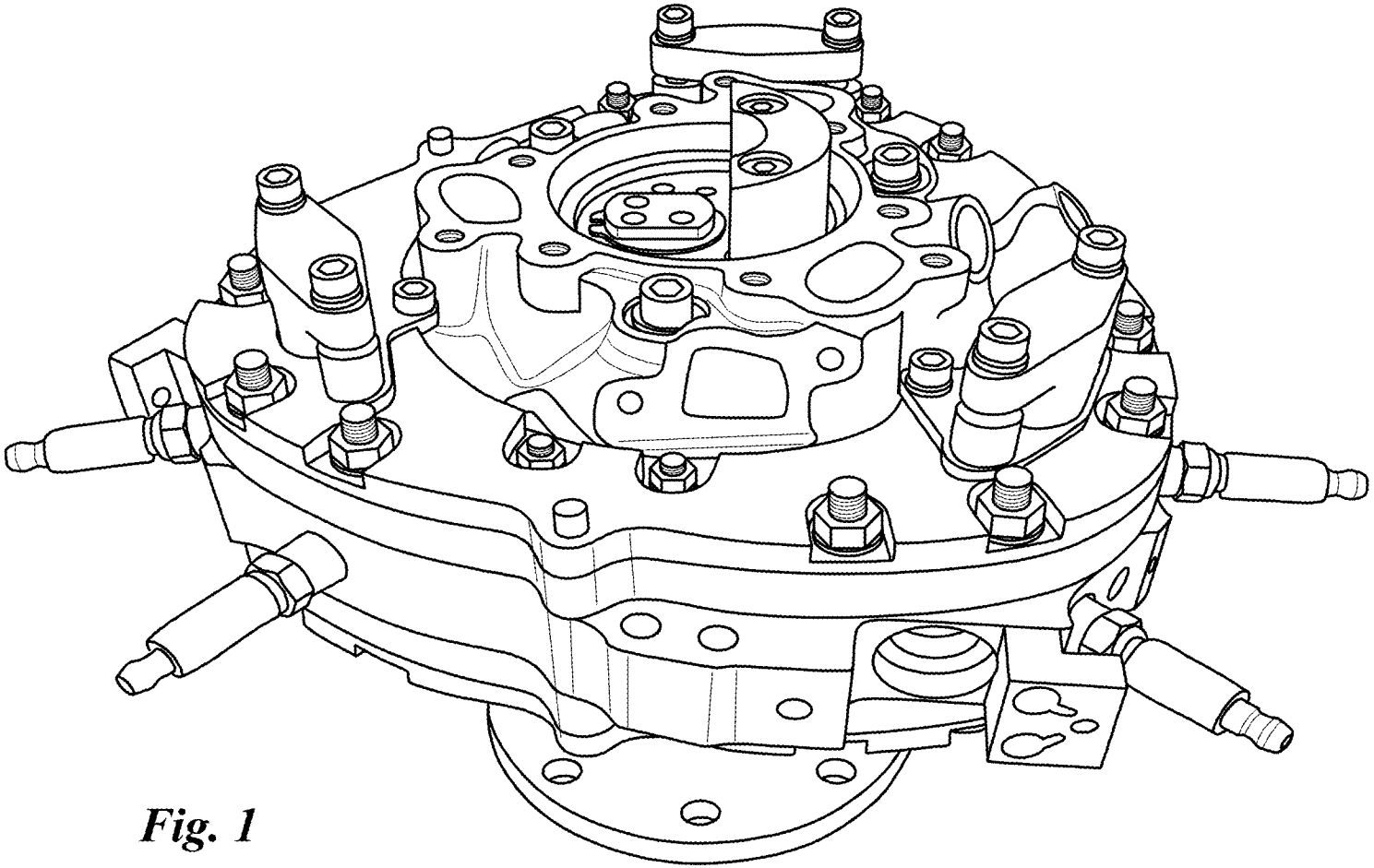
FIG. 1 is a photograph of a two-stroke rotary engine in accordance with an embodiment of the present invention.

FIG. 1 is a photograph of a two-stroke rotary engine in accordance with an embodiment of the present invention. In some embodiments, rotary engines described herein include, but are not limited to, engines and aspects of engines disclosed in U.S. Pat. Nos. 8,863,724; 8,365,699; 8,863,723; 9,353,623; 9,382,851; 9,528,435; 9,644,570; 9,810,068; 10,196,970; 10,125,675; 10,221,690; and 11,149,547, the disclosure of each which is incorporated by reference herein in its entirety.

Figure 2:
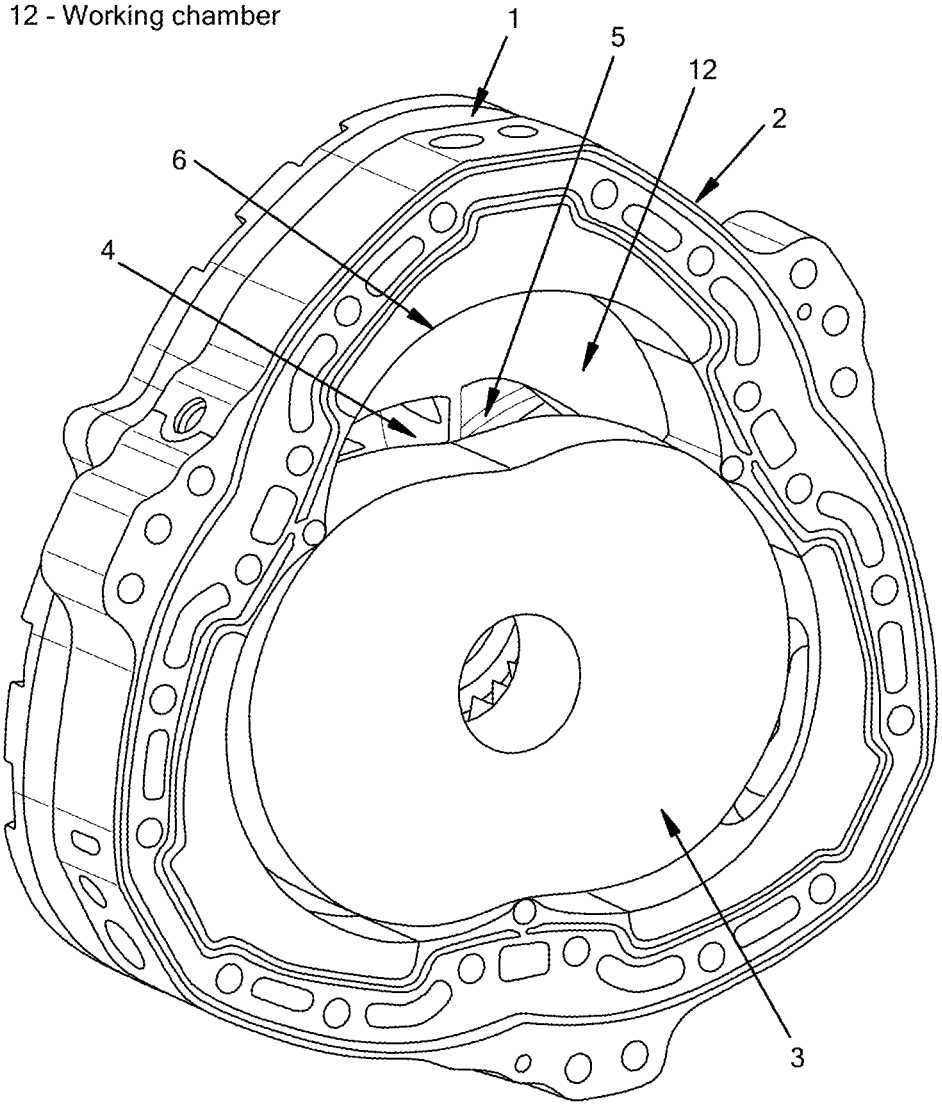
FIG. 2 is a perspective view of select components of the rotary engine of FIG. 1, in accordance with an embodiment of the present invention.

FIG. 2 is a perspective view of select components of the rotary engine of FIG. 1, in accordance with an embodiment of the present invention. Here, side plate 1 is mounted to housing 2. During operation, rotor 3 rotates within the housing so as to create working chamber 12 defined by working chamber boundary 6 in relation to the rotor. In some embodiments, intake port 4 and exhaust port 5 are formed in side plate 1. In some embodiments, intake port 4 is formed in side plate 1 and exhaust port 5 is formed in a second side plate (not shown) disposed on an opposite axial face of rotor 3 with respect to side plate 1. In other embodiments, exhaust port 5 is formed in side plate 1 and intake port 4 is formed in a second side plate (not shown) disposed on an opposite axial face of rotor 3 with respect to side plate 1. In some embodiments, intake port 4 is formed in side plate 1 and in a second side plate (not shown) disposed on an opposite axial face of rotor 3 with respect to side plate 1 and exhaust port 5 is formed in side plate 1 and in the second side plate.

Figure 3:
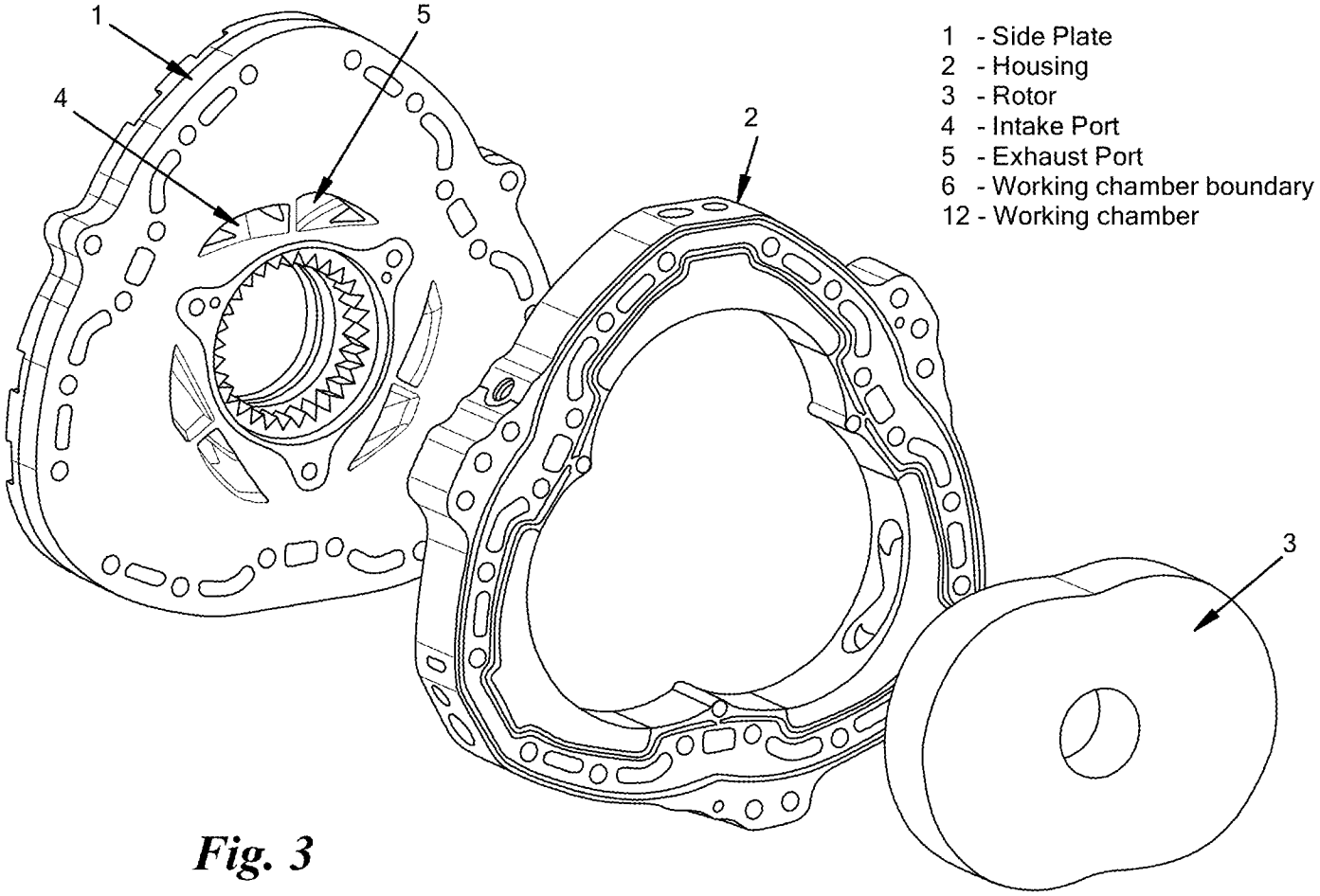
FIG. 3 is an exploded view of the components of FIG. 2, in accordance with an embodiment of the present invention.

FIG. 3 is an exploded view of the components of FIG. 2, in accordance with an embodiment of the present invention.

Figure 4:
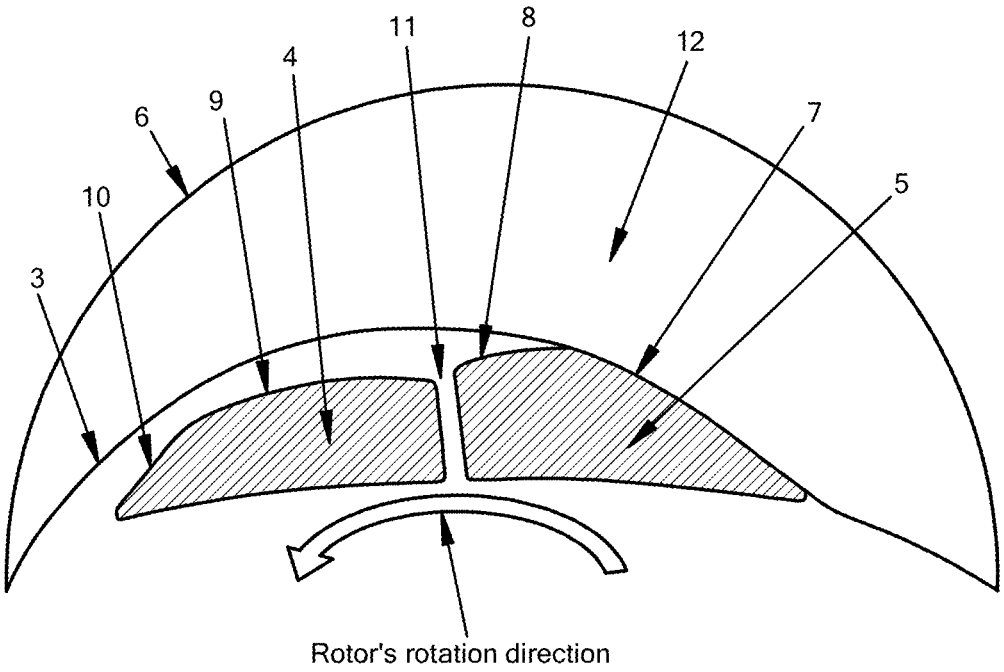
FIG. 4 is schematic of a working chamber, defined by a working chamber boundary, the working chamber having an intake port and an exhaust port set apart by a separator wall, in accordance with an embodiment of the present invention.

FIG. 4 is a schematic of working chamber 12, defined by working chamber boundary 6, the working chamber having intake port 4 and exhaust port 5, set apart by separator wall 11, in accordance with an embodiment of the present invention. Here, a leading portion 7 of a top edge of exhaust port 5 has a contour matched to that of a corresponding silhouette defined by an outline of the outer edge of rotor 3. Also shown are a trailing portion 8 of the top edge of exhaust port 5, a leading portion 9 of a top edge of intake port 4, and a trailing portion 10 of the top edge of intake port 4.

FIGS. 5*a-h* are successive illustrations over time of rotor 3 as it rotates counter-clockwise, passing over exhaust port 5 and intake port 4, in accordance with an embodiment of the present invention. Each of the top edge of exhaust port 5 and intake port 4 has a leading portion (7 and 9, respectively) and a trailing portion (8 and 10, respectively). We have found that in some embodiments, leading portion 7 of the top edge of the exhaust port should have a contour that matches the contour of rotor 3 when the rotor is in a position just before any opening the exhaust port 5, as in FIG. 5*a*. Similarly, trailing portion 8 of the top edge of exhaust port 5 should have a contour that matches the contour of rotor 3 when exhaust port 5 is first fully closed, as in FIG. 5*g*. Similarly, leading portion 9 of the top edge of intake port 4 should have a contour that matches the contour of rotor 3 when the rotor is in a position just before any opening of intake port 4, as in FIG. 5*c*. Similarly, trailing portion 10 of the top edge of the intake port 4 should have a contour that matches the contour of rotor 3 when intake port 4 is first fully closed, as in FIG. 5*h*.

In addition to contour matching of the ports in the manner described above, the relative areas of the intake and exhaust ports exposed to a working chamber can be configured to support desired performance characteristics of a two-stroke rotary engine, in accordance with embodiments of the invention. FIGS. 6*c*, 6*d*, and 6*e* illustrate embodiments in which contour matching has been implemented in each case for the intake and exhaust ports, but wherein the relative areas of the intake and exhaust ports are varied, in accordance with an embodiment of the present invention. For example, in FIG. 6*d*, the relative areas are equal, whereas in FIG. 6*c*, the exhaust port has approximately 25% of the total port area, and in FIG. 6*e*, the intake port has approximately 25% of the total port area.

Figure 6A:
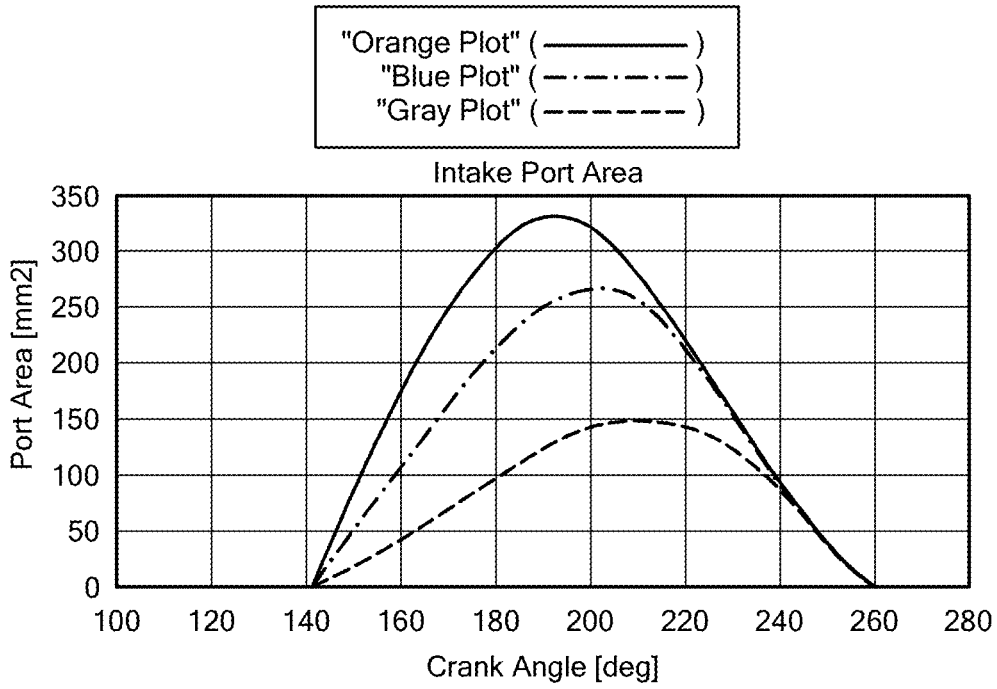
FIG. 6*a* is a plot of intake port area versus crank angle for intake and exhaust port configurations shown in FIG. 6*c* (orange plot), 6*d* (blue plot), and 6*e* (gray plot), in accordance with an embodiment of the present invention.
Figure 6B:
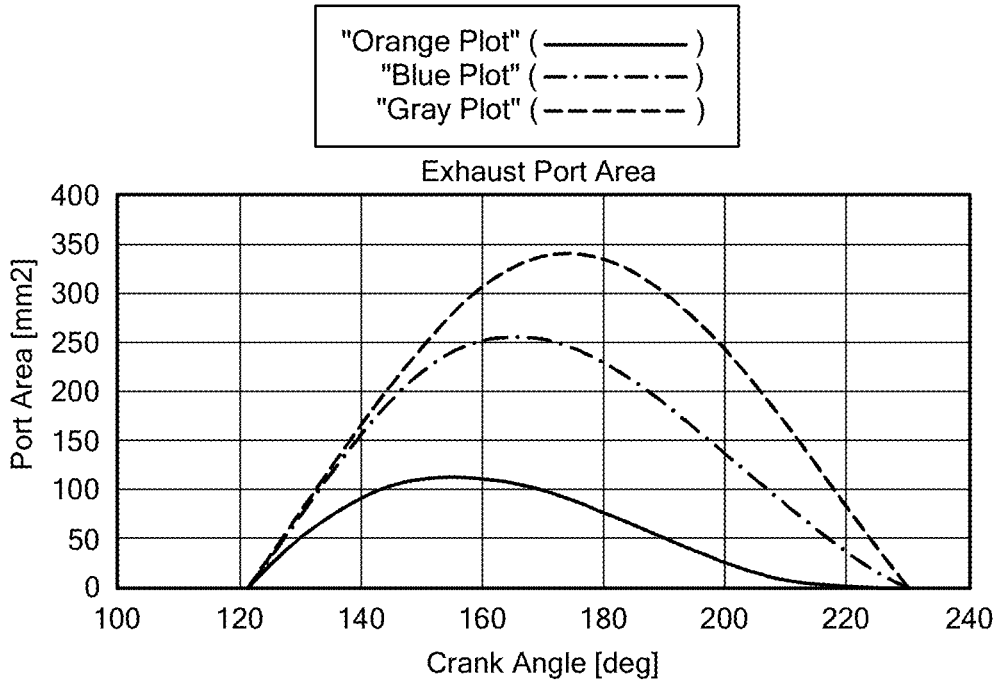
FIG. 6*b* is a plot of exhaust port area versus crank angle for intake and exhaust port configurations shown in FIG. 6*c* (orange plot), 6*d* (blue plot), and 6*e* (gray plot), in accordance with an embodiment of the present invention.
Figure 6C:
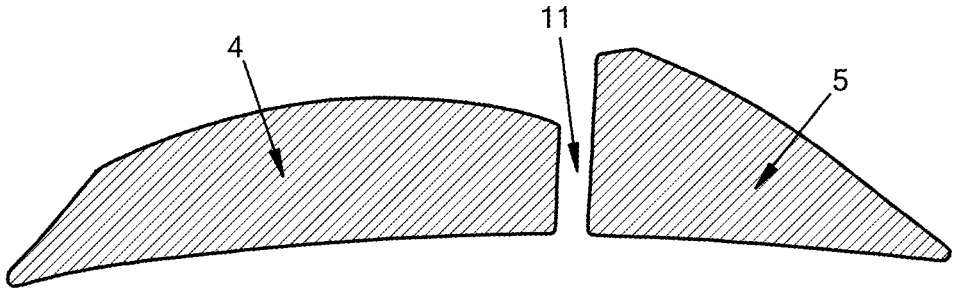
FIG. 6*c* illustrates an intake and exhaust port configuration in which the intake port has 75% of the total area of the sum of the intake port area and exhaust port area, in accordance with an embodiment of the present invention.
Figure 6D:
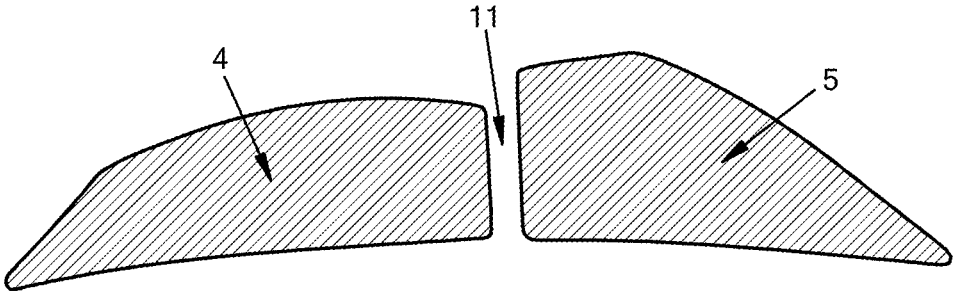
FIG. 6*d* illustrates an intake and exhaust port configuration in which the area of the intake port and the area of the exhaust port are equal, in accordance with an embodiment of the present invention.
Figure 6E:
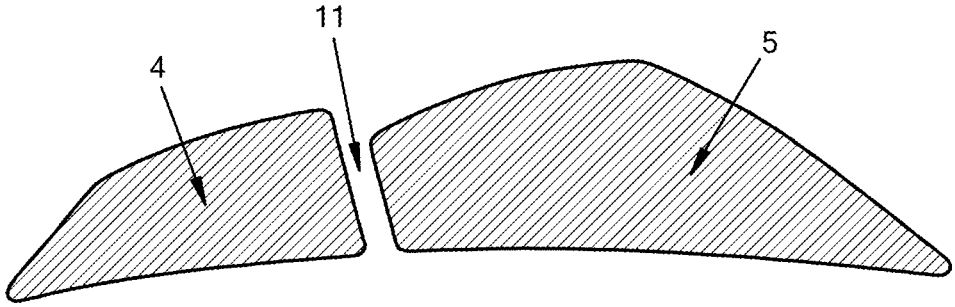
FIG. 6*e* illustrates an intake and exhaust port configuration in which the intake port has 25% of the total area of the sum of the intake port area and exhaust port area, in accordance with an embodiment of the present invention.

FIGS. 6*a* and 6*b* show plots of intake port 4 and exhaust 5 port area, respectively, exposed to the working chamber at various rotor crank angles for the embodiments shown in FIGS. 6*c*, 6*d*, and 6*e*, in accordance with an embodiment of the present invention. In FIGS. 6*a*, 6*b*, 6*c*, 6*d*, and 6*e*, it is assumed that the rotor, not shown, is turning counter-clockwise and with rotor crank angle increasing as the rotor turns counter-clockwise.

FIG. 6*a* shows separate plots of intake port area (exposed to the working chamber) as a function of rotor crank angle for the embodiments of FIG. 6*c* (orange plot), 6*d* (blue plot), and 6*e* (gray plot). It can be seen in FIGS. 6*c*, 6*d*, and 6*e* that separator wall 11 between the intake and exhaust ports shifts to the left as the exhaust port area is increased.

Similarly, in FIG. 6*b* shows separate plots of exhaust port area (exposed to the working chamber) as a function of rotor crank angle for the embodiments of FIG. 6*c* (orange plot), 6*d* (blue plot), and 6*e* (gray plot). It can be seen in FIGS. 6*c*, 6*d*, and 6*e* that separator wall 11 between the intake and exhaust ports to the left as the intake port area is decreased.

Although the relative intake port area and exhaust port area differ between the configurations shown in FIGS. 6*c-e*, port timings of each of these configurations, as a function of crank angle, are the same. That is, all else being equal, the crank angle at which the exhaust port begins to open, the intake port begins to open, the exhaust port becomes fully closed, and the intake port becomes fully closed, is the same for each of the configurations shown in FIGS. 6*c-e*.

Moreover, as shown in FIGS. 6*c*, 6*d*, and 6*e*, there is a congruence across these figures of the shape of the ports that are rendered. In other words, the shape of the intake port of FIG. 6*c* can be understood as also largely characterizing the shape of the intake ports of FIGS. 6*d* and 6*e*, but with separator wall 11 located at successively later angular orientations of the rotor in FIGS. 6*c*, 6*d*, and 6*e*, respectively. Similarly, the shape of the exhaust port of FIG. 6*e* can be understood as also largely characterizing the shape of the exhaust ports of FIGS. 6*d* and 6*c*, but with separator wall 11 located at successively earlier angular orientations of the rotor in FIGS. 6*e*, 6*d*, and 6*c*, respectively.

FIG. 6*a* shows that as the relative area of the intake port decreases, the crank angle at which the exhaust port is maximally open increases. Moreover, as the relative area of the intake port increases, the rate at which intake port area is exposed to the working chamber increases. Similarly, FIG. 6*b* shows that as the relative area of the exhaust port decreases, the crank angle at which the exhaust port is maximally open decreases. In addition, as the relative area of the exhaust port increases, the rate at which exhaust port area is closed off to the working chamber increases.

The plots in FIGS. 6*a* and 6*b* show the effects of shifting the location of separator wall 11 in configuration of intake and exhaust ports, and the accompanying change in their relative areas. In FIG. 6*c*, separator wall 11 is located in a manner that maximizes the relative area of the intake port and, therefore, causes its exposed area (plotted in FIG. 6*a*) to peak at a smaller crank angle of the rotor. Similarly, in In FIG. 6*e*, separator wall 11 is located in a manner that maximizes the relative area of the exhaust port and, therefore, causes its exposed area (plotted in FIG. 6*b*) to peak at a larger crank angle of the rotor.

Figure 7:
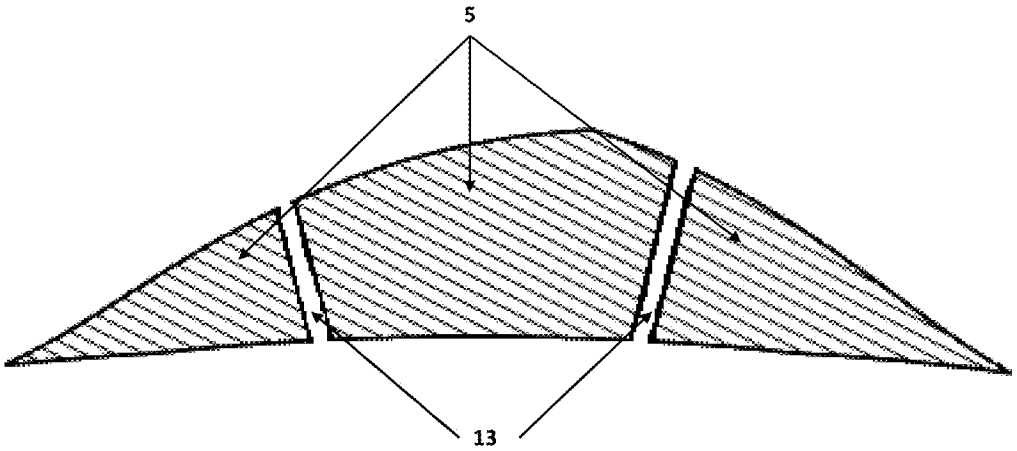
FIG. 7 is an exhaust port separated by two support bridges, in accordance with an embodiment of the present invention.

FIG. 7 shows exemplary exhaust port 5 formed in three distinct segments, each segment separated by bridge 13, in accordance with an embodiment of the present invention. Bridge 13 provides support for sealing elements, e.g., a face seal of rotor 3, as they cross the port opening and help direct flow. A bridge may be utilized for exhaust ports and intake ports in order to provide support. Although FIG. 7 shows an exemplary exhaust port having two bridges 13, a given port may have any number of bridges.

In some embodiments, a rotary engine disclosed herein further comprises a fuel injector configured to inject fuel into at least one working chamber of the rotary engine.

Various embodiments of the present invention may be characterized by the potential claims listed in the paragraphs following this paragraph (and before the actual claims provided at the end of this application). These potential claims form a part of the written description of this application. Accordingly, subject matter of the following potential claims may be presented as actual claims in later proceedings involving this application or any application claiming priority based on this application. Inclusion of such potential claims should not be construed to mean that the actual claims do not cover the subject matter of the potential claims. Thus, a decision to not present these potential claims in later proceedings should not be construed as a donation of the subject matter to the public.

Without limitation, potential subject matter that may be claimed (prefaced with the letter "P" so as to avoid confusion with the actual claims presented below) includes:

P1. An improved engine of the type including a cycloidal rotor having N identical lobes, each lobe having a contour, the contour being defined by a silhouette of the lobe, and a housing having a corresponding set of N+1 lobe-receiving regions, wherein N≥2, for successively receiving the lobes as the rotor rotates about an axis relative to the housing, the housing having (i) a pair of side plates axially disposed on first and second sides of the rotor, each of the side plates defining an interior plane with which the rotor is in contact, and (ii) a peak disposed between each pair of adjacent lobe-receiving regions, at least one working chamber being formed in a space between the rotor and the housing, the at least one working chamber having an exhaust port and an intake port, each port communicating with the at least one working chamber through one of the side plates, such ports being closed successively by the lobes during rotation of the rotor and opened to the at least one working chamber as a given lobe is rotated, the intake port having a top edge and the exhaust port having a top edge, wherein the improvement comprises configuring the intake port and the exhaust port so that:

(a) a leading portion of the top edge of the exhaust port has a contour that matches a first corresponding portion of the contour of the given lobe when the rotor is in an angular orientation just before any opening by the given lobe of the exhaust port, and (b) a trailing portion of the top edge of the exhaust port has a contour that matches a second corresponding portion of the contour of the given lobe when the rotor is in an angular orientation when the exhaust port is first fully closed.

P2. An improved engine of the type including a cycloidal rotor having N identical lobes, each lobe having a contour, the contour being defined by a silhouette of the lobe, and a housing having a corresponding set of N+1 lobe-receiving regions, wherein N≥2, for successively receiving the lobes as the rotor rotates about an axis relative to the housing, the housing having (i) a pair of side plates axially disposed on first and second sides of the rotor, each of the side plates defining an interior plane with which the rotor is in contact, and (ii) a peak disposed between each pair of adjacent lobe-receiving regions, at least one working chamber being formed in a space between the rotor and the housing, the at least one working chamber having an exhaust port and an intake port, each port communicating with the at least one working chamber through one of the side plates, such ports being closed successively by the lobes during rotation of the rotor and opened to the at least one working chamber as a given lobe is rotated, the intake port having a top edge and the exhaust port having a top edge, wherein the improvement comprises configuring the intake port and the exhaust port so that:

(a) a leading portion of the top edge of the intake port has a contour that matches a third corresponding portion of the contour of the given lobe when the rotor is in an angular orientation just before any opening by the given lobe of the intake port, and (b) a trailing portion of the top edge of the intake port has a contour that matches a fourth corresponding portion of the contour of the given lobe when the rotor is in an angular orientation when the intake port is first fully closed.

P3. An improved engine of the type including a cycloidal rotor having N identical lobes, each lobe having a contour, the contour being defined by a silhouette of the lobe, and a housing having a corresponding set of N+1 lobe-receiving regions, wherein N≥2, for successively receiving the lobes as the rotor rotates about an axis relative to the housing, the housing having (i) a pair of side plates axially disposed on first and second sides of the rotor, each of the side plates defining an interior plane with which the rotor is in contact, and (ii) a peak disposed between each pair of adjacent lobe-receiving regions, at least one working chamber being formed in a space between the rotor and the housing, the at least one working chamber having an exhaust port and an intake port, each port communicating with the at least one working chamber through one of the side plates, such ports being closed successively by the lobes during rotation of the rotor and opened to the at least one working chamber as a given lobe is rotated, the intake port having a top edge and the exhaust port having a top edge, wherein the improvement comprises configuring the intake port and the exhaust port so that:

(a) a leading portion of the top edge of the exhaust port has a contour that matches a first corresponding portion of the contour of the given lobe when the rotor is in an angular orientation just before any opening by the given lobe of the exhaust port, (b) a trailing portion of the top edge of the exhaust port has a contour that matches a second corresponding portion of the contour of the given lobe when the rotor is in an angular orientation when the exhaust port is first fully closed, (c) a leading portion of the top edge of the intake port has a contour that matches a third corresponding portion of the contour of the given lobe when the rotor is in an angular orientation just before any opening by the given lobe of the intake port, and (d) a trailing portion of the top edge of the intake port has a contour that matches a fourth corresponding portion of the contour of the given lobe when the rotor is in an angular orientation when the intake port is first fully closed.

P4. The improved engine of any one of potential subject matter P1-P4, wherein the exhaust port has an exhaust port area, at its corresponding interior plane, that is greater than an intake port area of the intake port at its corresponding interior plane.

P5. The improved engine of any one of potential subject matter P1-P3, wherein the intake port has an intake port area, at its corresponding interior plane, that is greater than an exhaust port area of the exhaust port at its corresponding interior plane.

P6. The improved engine of any one of potential subject matter P1-P3, wherein the exhaust port has an exhaust port area, at its corresponding interior plane, that is equal to an intake port area at its corresponding interior plane.

P7. The improved engine of potential subject matter P4, wherein the exhaust port area is at least 50% greater than the intake port area.

P8. The improved engine of potential subject matter P4, wherein the exhaust port area is at least three times greater than the intake port area.

P9. The improved engine of potential subject matter P5, wherein the intake port area is at least three times greater than the exhaust port area.

P10. The improved engine of potential subject matter P5, wherein the intake port area is at least 50% greater than the exhaust port area.

P11. The improved engine of potential subject matter P4, wherein the exhaust port area is at least two times greater than the intake port area.

P12. The improved engine of potential subject matter P5, wherein the intake port area is at least two times greater than the exhaust port area.

P13. The improved engine of any one of potential subject matter P1-P12, wherein a separator wall separates the exhaust port from the intake port.

P14. The improved engine of any one of potential subject matter P1-P13, wherein the exhaust port comprises at least one bridge.

P15. The improved engine of any one of potential subject matter P1-P14, wherein the intake port comprises at least one bridge.

P16. The improved engine of any one of potential subject matter P1-P15, wherein the engine further comprises a fuel injector configured to inject fuel into the at least one working chamber.

P17. The improved engine of any one of potential subject matter P1-P16, wherein the exhaust port and the intake port are configured in the side plate in a manner so that when the rotor is in a position causing the exhaust and intake ports to be fully closed, further rotation of the rotor in its normal direction of rotation will cause the exhaust port to open before the intake port.

P18. The improved engine of any one of potential subject matter P1-P17, wherein the exhaust port and the intake port are configured in the side plate in a manner so that when the rotor is in a position causing the exhaust and intake ports to be open, further rotation of the rotor in its normal direction of rotation will cause the exhaust port to be fully closed before the intake port is fully closed.

The embodiments of the invention described above are intended to be merely exemplary; numerous variations and modifications will be apparent to those skilled in the art. All such variations and modifications are intended to be within the scope of the present invention as defined in any appended claims.

What is claimed is:

1. An improved engine including a cycloidal rotor having N identical lobes, each lobe having a contour, the contour being defined by a silhouette of the lobe, and a housing having a corresponding set of N+1 lobe-receiving regions, wherein N≥2, for successively receiving the lobes as the rotor rotates about an axis relative to the housing, the housing having (i) a pair of side plates axially disposed on first and second sides of the rotor, each of the side plates defining an interior plane with which the rotor is in contact, and (ii) a peak disposed between each pair of adjacent lobe-receiving regions, at least one working chamber being formed in a space between the rotor and the housing, the at least one working chamber having an exhaust port and an intake port, each port communicating with the at least one working chamber through one of the side plates, such ports being closed successively by the lobes during rotation of the rotor and opened to the at least one working chamber as a given lobe is rotated, the intake port having a top edge and the exhaust port having a top edge, wherein the intake port and the exhaust port are configured so that:

(a) a leading portion of the top edge of the exhaust port has a contour that matches a first corresponding portion of the contour of the given lobe when the rotor is in an angular orientation just before any opening by the given lobe of the exhaust port, and (b) a trailing portion of the top edge of the exhaust port has a contour that matches a second corresponding portion of the contour of the given lobe when the rotor is in an angular orientation when the exhaust port is first fully closed.

2. The improved engine of claim 1, wherein the intake port and the exhaust port are configured so that:

(c) a leading portion of the top edge of the intake port has a contour that matches a third corresponding portion of the contour of the given lobe when the rotor is in an angular orientation just before any opening by the given lobe of the intake port, and (d) a trailing portion of the top edge of the intake port has a contour that matches a fourth corresponding portion of the contour of the given lobe when the rotor is in an angular orientation when the intake port is first fully closed.

3. The improved engine of claim 2, wherein the exhaust port has an exhaust port area, at its corresponding interior plane, that is greater than an intake port area of the intake port at its corresponding interior plane.

4. The improved engine of claim 3, wherein the exhaust port area is at least 50% greater than the intake port area.

5. The improved engine of claim 3, wherein the exhaust port area is at least three times greater than the intake port area.

6. The improved engine of claim 3, wherein the exhaust port area is at least two times greater than the intake port area.

7. The improved engine of claim 2, wherein the intake port has an intake port area, at its corresponding interior plane, that is greater than an exhaust port area of the exhaust port at its corresponding interior plane.

8. The improved engine of claim 7, wherein the intake port area is at least three times greater than the exhaust port area.

9. The improved engine of claim 7, wherein the intake port area is at least 50% greater than the exhaust port area.

10. The improved engine of claim 7, wherein the intake port area is at least two times greater than the exhaust port area.

11. The improved engine of claim 2, wherein the exhaust port has an exhaust port area, at its corresponding interior plane, that is equal to an intake port area at its corresponding interior plane.

12. The improved engine of claim 2, wherein a separator wall separates the exhaust port from the intake port.

13. The improved engine of claim 2, wherein the exhaust port comprises at least one bridge.

14. The improved engine of claim 2, wherein the intake port comprises at least one bridge.

15. The improved engine of claim 2, wherein the engine further comprises a fuel injector configured to inject fuel into the at least one working chamber.

16. The improved engine of claim 2, wherein the exhaust port and the intake port are configured in the side plate in a manner so that when the rotor is in a position causing the exhaust and intake ports to be fully closed, further rotation of the rotor in its normal direction of rotation will cause the exhaust port to open before the intake port.

17. The improved engine of claim 2, wherein the exhaust port and the intake port are configured in the side plate in a manner so that when the rotor is in a position causing the exhaust and intake ports to be open, further rotation of the rotor in its normal direction of rotation will cause the exhaust port to be fully closed before the intake port is fully closed.

18. An improved engine of the type including a cycloidal rotor having N identical lobes, each lobe having a contour, the contour being defined by a silhouette of the lobe, and a housing having a corresponding set of N+1 lobe-receiving regions, wherein N≥2, for successively receiving the lobes as the rotor rotates about an axis relative to the housing, the housing having (i) a pair of side plates axially disposed on first and second sides of the rotor, each of the side plates defining an interior plane with which the rotor is in contact, and (ii) a peak disposed between each pair of adjacent lobe-receiving regions, at least one working chamber being formed in a space between the rotor and the housing, the at least one working chamber having an exhaust port and an intake port, each port communicating with the at least one working chamber through one of the side plates, such ports being closed successively by the lobes during rotation of the rotor and opened to the at least one working chamber as a given lobe is rotated, the intake port having a top edge and the exhaust port having a top edge, wherein the intake port and the exhaust port are configured so that:

(a) a leading portion of the top edge of the intake port has a contour that matches a third corresponding portion of the contour of the given lobe when the rotor is in an angular orientation just before any opening by the given lobe of the intake port, and (b) a trailing portion of the top edge of the intake port has a contour that matches a fourth corresponding portion of the contour of the given lobe when the rotor is in an angular orientation when the intake port is first fully closed.

* * * * *